US006253492B1

(12) United States Patent
Finke

(10) Patent No.: US 6,253,492 B1
(45) **Date of Patent: *Jul. 3, 2001**

(54) HOUSING FOR AUTOMATIC DOOR MECHANISMS HAVING A HINGED CONNECTION

(75) Inventor: Andreas Finke, Gevelsberg (DE)

(73) Assignee: Dorma GmbH + Co. KG Ennepetal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/415,340

(22) Filed: Oct. 8, 1999

(30) Foreign Application Priority Data

Feb. 9, 1998 (DE) ..... 198 04 859

(51) Int. Cl.[7] ..... E05D 15/00

(52) U.S. Cl. ..... 49/409; 49/404; 16/87.4 R; 160/19

(58) Field of Search ..... 49/404, 409; 160/19, 160/22, 38, 39; 52/717.01, 718.04; 16/87.4 R

(56) References Cited

U.S. PATENT DOCUMENTS

| | | | | |
|---|---|---|---|---|
| 1,575,083 | * | 3/1926 | Tracy | 49/261 |
| 2,653,656 | * | 9/1953 | Kuebler | 160/19 |
| 3,060,492 | | 10/1962 | Dellith . | |
| 3,297,075 | * | 1/1967 | Howell et al. | 160/19 |
| 3,473,266 | * | 10/1969 | Miller | 49/504 |
| 3,886,685 | * | 6/1975 | Riphagen | 49/209 |
| 4,404,770 | * | 9/1983 | Markus | 49/235 |
| 4,452,014 | * | 6/1984 | Markus | 49/360 |
| 5,121,782 | * | 6/1992 | Renkhoff et al. | 160/22 |
| 5,285,837 | * | 2/1994 | Pozzi | 160/22 |
| 5,296,964 | * | 3/1994 | Shopp | 359/443 |
| 5,307,856 | * | 5/1994 | Murray | 160/70 |
| 5,333,663 | * | 8/1994 | Eger | 160/22 |
| 5,365,989 | * | 11/1994 | Eger et al. | 160/22 |
| 5,427,168 | * | 6/1995 | Lohausen | 160/66 |
| 5,673,739 | * | 10/1997 | Brutsaet | 160/22 |
| 5,819,830 | * | 10/1998 | Verelst | 160/22 |
| 6,024,152 | * | 2/2000 | Rosenich | 160/22 |

FOREIGN PATENT DOCUMENTS

| | | | | |
|---|---|---|---|---|
| 3015990 | * | 11/1971 | (DE) | 160/22 |
| 3001919 | * | 7/1981 | (DE) | 160/19 |
| 4303784 | | 8/1993 | (DE) . | |
| 9419652 | | 3/1995 | (DE) . | |

OTHER PUBLICATIONS

Product catalog published by Schüco International.

* cited by examiner

*Primary Examiner*—Daniel P. Stodola
*Assistant Examiner*—Gregory J. Strimbu
(74) *Attorney, Agent, or Firm*—Nils H. Ljungman & Associates

(57) ABSTRACT

A hinged connection between a removable housing closure and a stationary housing part, wherein a terminal configuration of the housing closure has a convex molding, with a web that is contiguous with the molding and which web has a tapering cross section. Adjacent to the web there is an indentation, in which a convex molding that is on the stationary housing part and is offset at an angle of 90 degrees from a projecting leg and is connected to the projecting leg by a contiguous web that has a tapering cross section is engaged. The housing closure can thereby be pivoted with respect to the stationary housing part and re-engaged with it. Additionally, when the housing is closed, no parts project either inside or outside in the vicinity of the housing closure and the stationary housing part.

8 Claims, 7 Drawing Sheets

HOUSING FOR AUTOMATIC DOOR MECHANISMS HAVING A HINGED CONNECTION

BACKGROUND OF THE INVENTION

1. Field of the Invention

The present invention relates to a hinged connection between a removable housing closure and a stationary housing part. Such housings are used in particular in automatic pivot-hung doors or in drive systems for hinged doors.

In at least one embodiment, the present invention further relates to an automatic door or partition system having hanging partitions or hinged doors. The system utilizes a hinged connection for a removable housing closure or access panel.

2. Background Information

German Patent No. 94 19 652 U1 describes a latch mechanism for the connection of two halves of a suitcase. The latching mechanism is realized in the form of a hinged system and in particular in the form of a hinged catch. This hinged catch can be locked and unlocked. The hinged catch thereby has a snap-in bulb that is realized in the form of a molded-on ball that can be engaged in mating snap-in bulbs.

In a product catalog published by Schuco International, various door profiles are illustrated as part of the Royal S 55 series. This catalog also shows profiles that have a projection in which there is a continuous boring, but which at one point has an opening in the side wall. Gaskets, in particular brush gaskets made of Perlon fibers, or door closing profiles in the form of rubber strips can be inserted in such profiles, which are specifically designated latching profiles.

On equipment paneling, in particular of the type described above for automatic doors, problems are frequently encountered when opening these panels because they are generally several meters long and are usually located above the pivoting or rotating panels of the door. For example, the folding part of the housing is extraordinarily difficult for an installer to handle, both during removal and replacement of the panel.

OBJECT OF THE INVENTION

The object of the present invention is to substantially eliminate the deficiencies of similar devices of the known art, and specifically to create an easy-to-operate and simultaneously substantially unseen or invisible, long-lasting, hinged connection between a removable housing closure and a stationary housing part.

It must thereby be possible not only to pivot the removable housing part, but also to remove it in its entirety from the stationary housing part without the need to use tools. In addition, no projecting parts should be visible either in the interior of the housing or on the outside.

SUMMARY OF THE INVENTION

The present invention teaches that this object can be accomplished by a terminal configuration of the housing closure that can have a convex molding, with a web that is contiguous with the molding and has a tapering cross section. Contiguous with the web there can be an indentation, in which a convex molding that is on the stationary housing part and is offset by an angle of approximately 90 degrees with respect to the molding can be engaged by means of a contiguous web that has a tapering cross section. The housing closure thereby can be pivoted with respect to the stationary housing part and re-engaged with it. Additional configurations of at least one embodiment of the present invention are described in the features hereinbelow.

The present invention teaches a special terminal configuration both of the movable and removable housing closure and of the stationary housing part. On the housing closure, there can be a convex molding that can have a spherical head, for example, whereby contiguous with this head there is a tapered part of the material, i.e. there is a leg or a web that is thinner than the convex molding. In a continuation of the above mentioned web, and contiguous with it, there is an indentation in the profile which can serve as a receptacle for a piece that is molded onto the stationary housing part but can be offset at an angle of approximately 90 degrees with respect to the removable housing part. This molded-on part can also be realized in the shape of a ball, and contiguous with it there is a web or a tapered portion, just as on the removable housing closure. The tapered portion emerges into a web or leg of the stationary housing part, which web or leg is offset at an angle of approximately 90 degrees, whereby on this stationary housing part there can also be an indentation that is realized so that the spherical molded part of the removable housing part can be engaged in it. To achieve a substantially noiseless mechanism as well as a solid and secure seating of both parts, i.e. of both the stationary housing part and also of the removable housing closure, the convex moldings can be provided, at least in partial areas, with a covering made of plastic. When the removable housing part is inserted into the indentation and is pulled down, it can be essentially guaranteed that the two housing parts will be hooked to each other, which produces a positive connection, and, with the application of a small amount of force, also a non-positive connection. The housing parts can preferably be fabricated from aluminum or from an aluminum alloy.

The above discussed embodiments of the present invention will be described further hereinbelow with reference to the accompanying figures. When the word "invention" is used in this specification, the word "invention" includes "inventions," that is, the plural of "invention." By stating "invention," the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to at least one possible exemplary embodiment that is illustrated in the accompanying drawings, which show only a portion of the exemplary embodiments between a stationary housing part and a removable housing part.

FIG. 3 shows before the insertion of the housing closure into the stationary housing part;

FIG. 4 shows the housing closure is inserted into the housing part;

FIG. 5 shows the housing closure and housing part of FIG. 4, shortly before the locking;

FIG. 6 shows the beginning of the locking process;

DESCRIPTION OF THE PREFERRED EMBODIMENT

Figure 1:
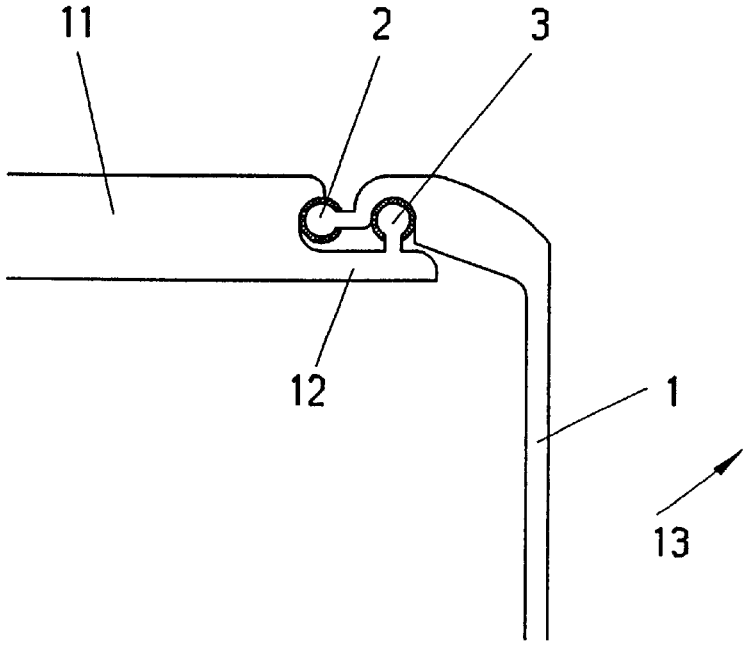
FIG. 1 shows a locked connection between the stationary housing part and the removable housing closure.
Figure 2:
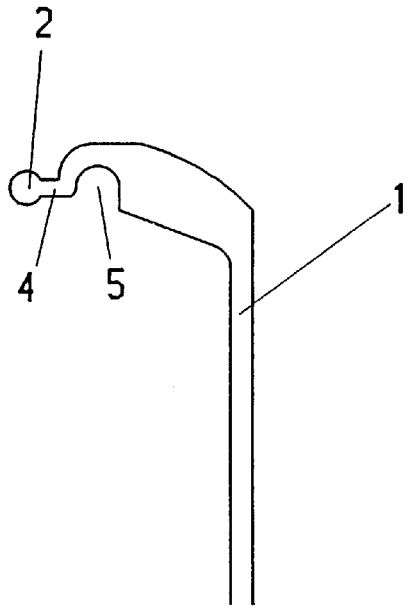
FIG. 2 shows the removable housing closure.

FIG. 1 shows a stationary housing part 11 which can be connected with and also detached from a removable housing closure 1, positively and non-positively, without the need to use tools. The housing closure 1, in its terminal area (longitudinal edges), is realized with a convex molding 2, e.g. in the form of a portion of a sphere. Contiguous with the convex molding 2 is a web 4 which makes a transition into the housing closure 1. Behind the shoulder of the web 4, there is an indentation 5, which is realized so that it can interact with the stationary housing part 11, i.e. the parts to be connected have coordinated dimensions.

In at least one embodiment according to the present invention, the stationary housing part 11 can be connected with the removable housing closure 1 by a form fitting, contour fitting, contact fitting, friction fitting or clamping to create a substantially stable connection. The housing closure 1 can be removed though by the application of force as discussed hereinbelow. This type of substantially stable connection that is also detachable is what is meant by positively and non-positively connected in at least one embodiment according to the present invention.

Figure 3:
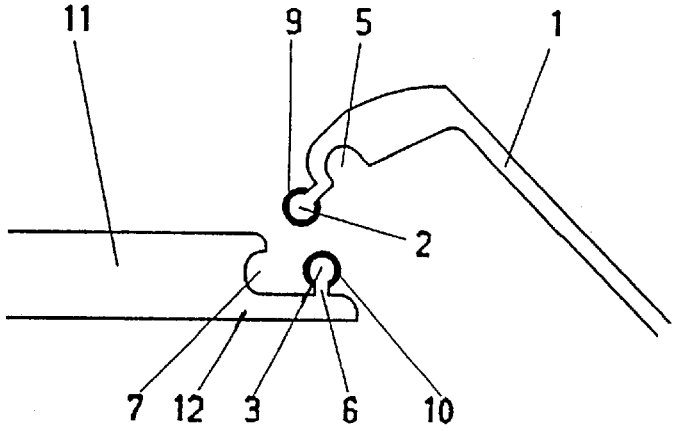
FIGS. 3 to 6 illustrate individual phases during the locking between the stationary housing part and the removable housing closure.
Figure 4:
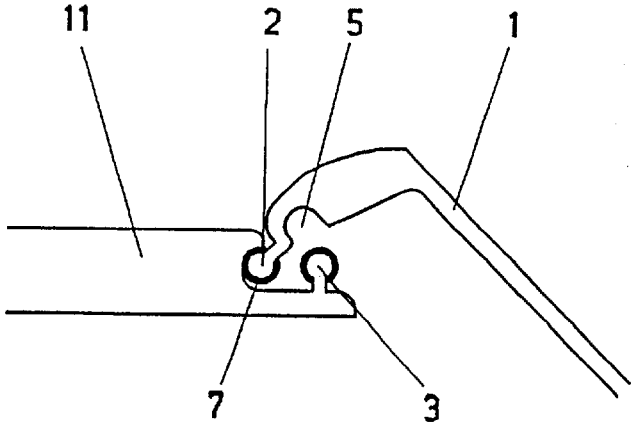
Figure 5:
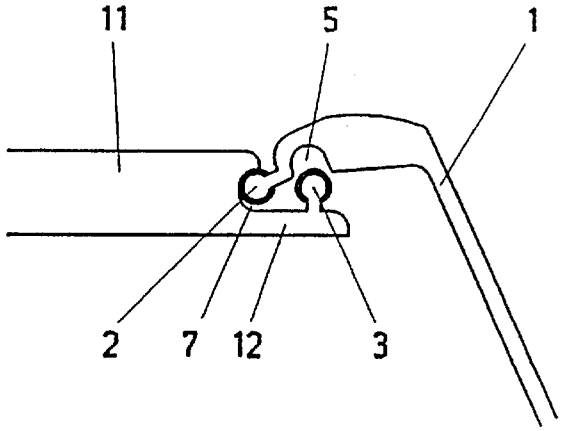
Figure 6:
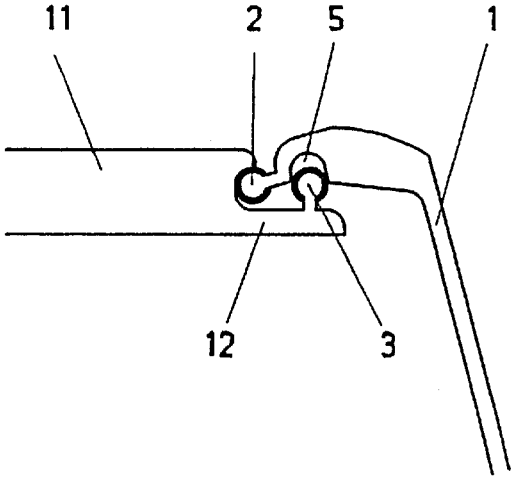

The details of the stationary housing part 11 are shown clearly in FIG. 3, whereby once again it should be noted that all of the illustrations show portions both of the stationary housing part 11 and also of the housing closure 1. The portion of the stationary housing part 11 is shown tapering in its terminal area into a leg 12. In the area where the portion tapers, there is an indentation 7 in the stationary housing part 11. The projecting leg 12, near its end, has a web 6 that is bent at about a 90 degree angle, on the free end of which web there is a convex molding 3, in the same manner as on the housing closure 1. The coordination of dimensions between the indentation 7 and the convex molding 3 of the stationary housing part 11 is thus coordinated with the housing closure 1, so that the convex molding 2 can be inserted inside the indentation 7 and the convex molding 3 can be inserted into the indentation 5. Consequently, the convex molding 2 is inserted into the indentation 7, as shown in FIG. 4, and thus provides an opportunity to affix the housing closure 1 to the stationary housing part 11. If the housing closure 1 is then pivoted further on the housing, which is not illustrated in any further detail, then as shown in FIG. 5, the convex molding 3 is supported in the vicinity of the indentation 5, whereby simultaneously the convex molding 2 is supported in the indentation 7. When the convex molding 3 and the indentation 5 come together, a small amount of force must be applied to effect a locking between the housing closure 1 and the stationary housing part 11, as shown in FIG. 6. Because both the convex molding 2 and the convex molding 3 are provided, at least in partial areas, with coverings 9, 10 in the form of plastic sheaths, the entire connection between the housing closure 1 and the stationary housing part 11 is at least partly elastic, so that in addition to an acoustical insulation, there is simultaneously an essentially clean and long-lasting locking between the housing closure 1 and the stationary housing part 11.

This connection is substantially permanent so that essentially no tools are required to attach or to detach this connection. To release the housing closure 1, all that is essentially necessary is to pivot the housing closure 1 in the direction 13, which causes an unlocking of the connection described above between the convex moldings 2, 3 and the indentations 5, 7.

Figure 7:
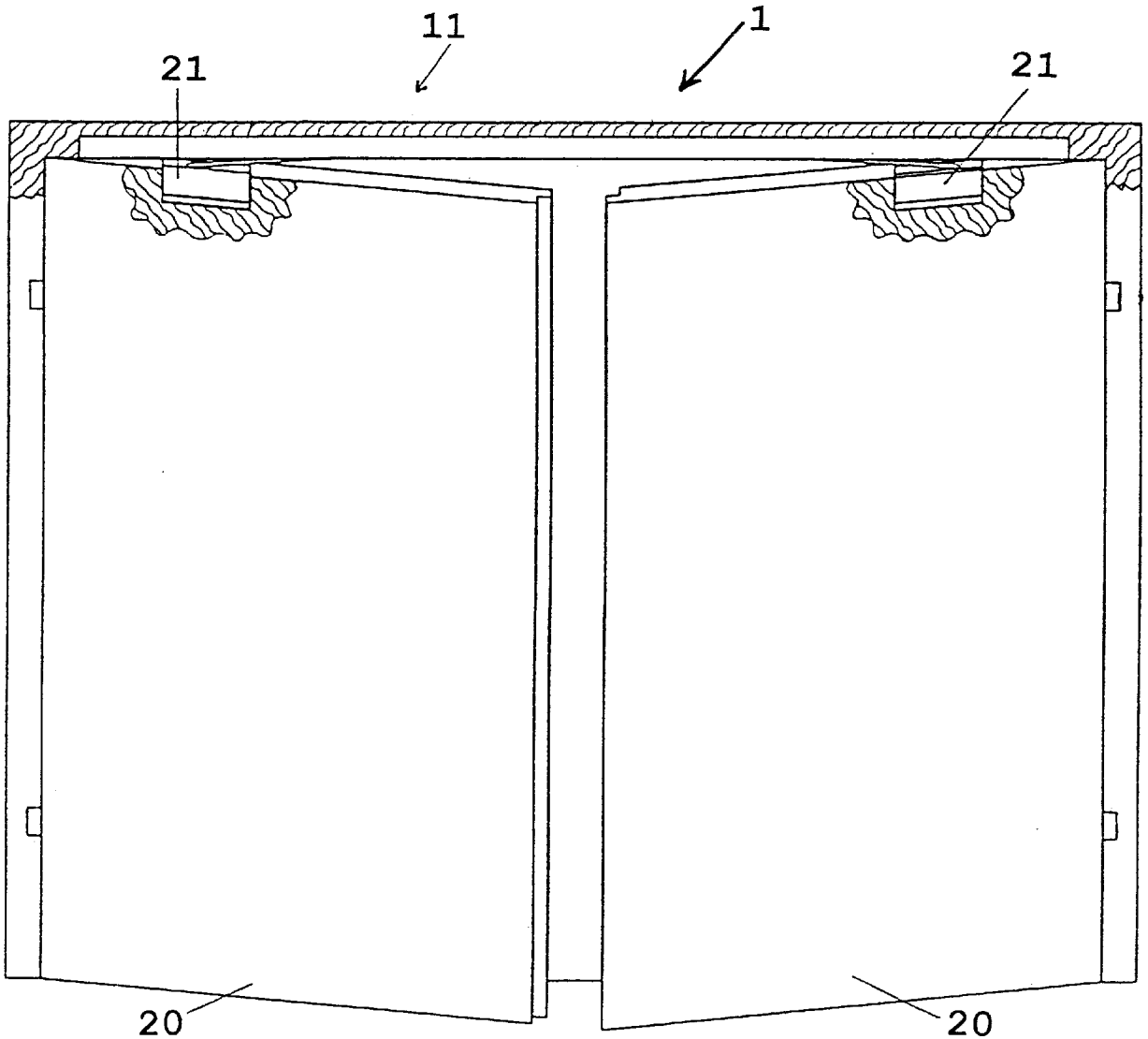
FIG. 7 shows a door system having a removable housing closure according to at least one embodiment of the present invention.

FIG. 7 shows a door system having door panels 20 and closing devices 21. The removable housing closure 1 and stationary housing part 11 can be located adjacent the upper portion of the door system, according to at least one embodiment of the present invention.

Figure 8:
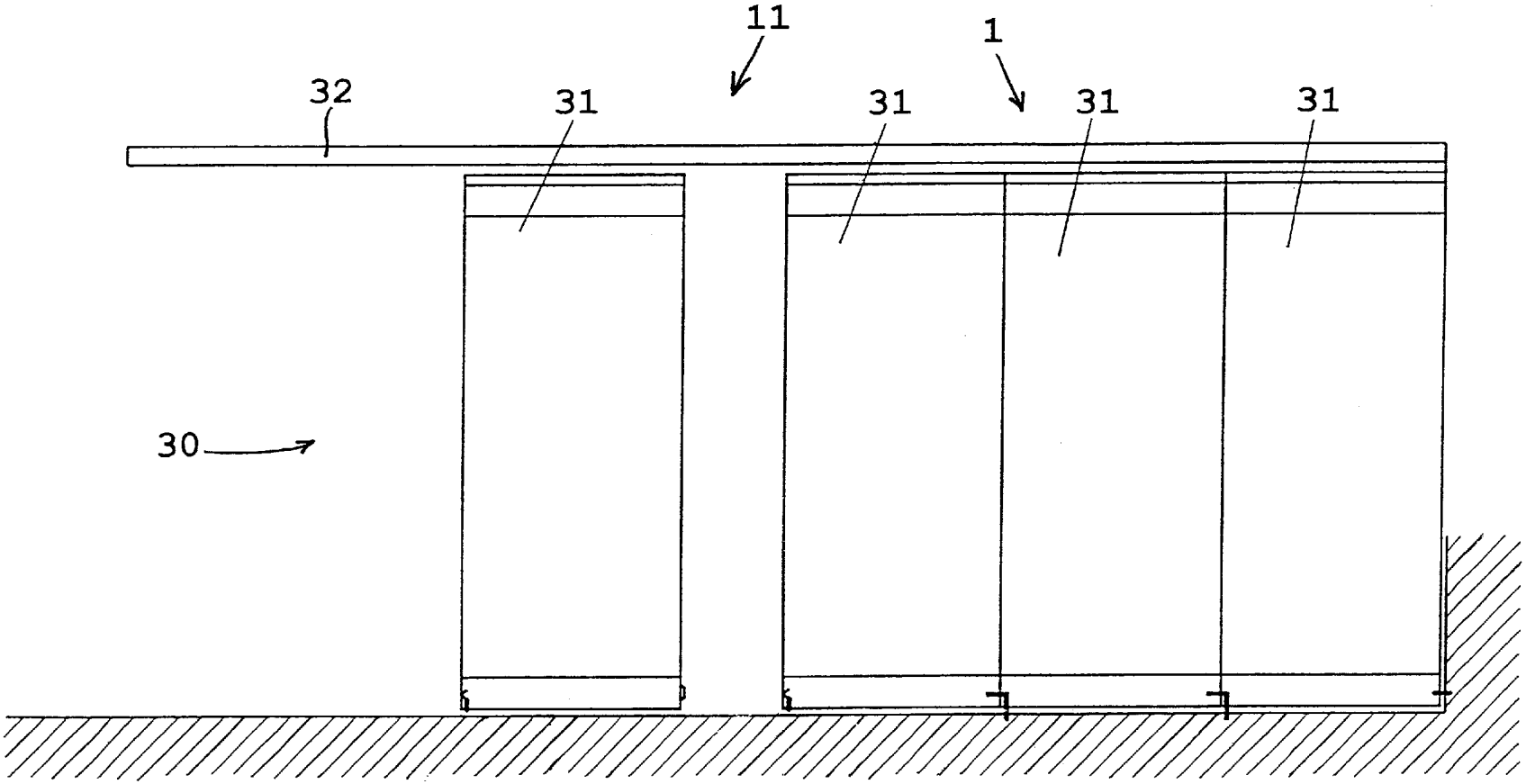
FIG. 8 shows a movable partition system having a removable housing closure according to at least one embodiment of the present invention.

FIG. 8 shows a movable partition system 30 having movable partitions 31 and a guide rail 32. The removable housing closure 1 and stationary housing part 11 can be located adjacent to the guide rail 32, according to at least one embodiment of the present invention.

Figure 9:
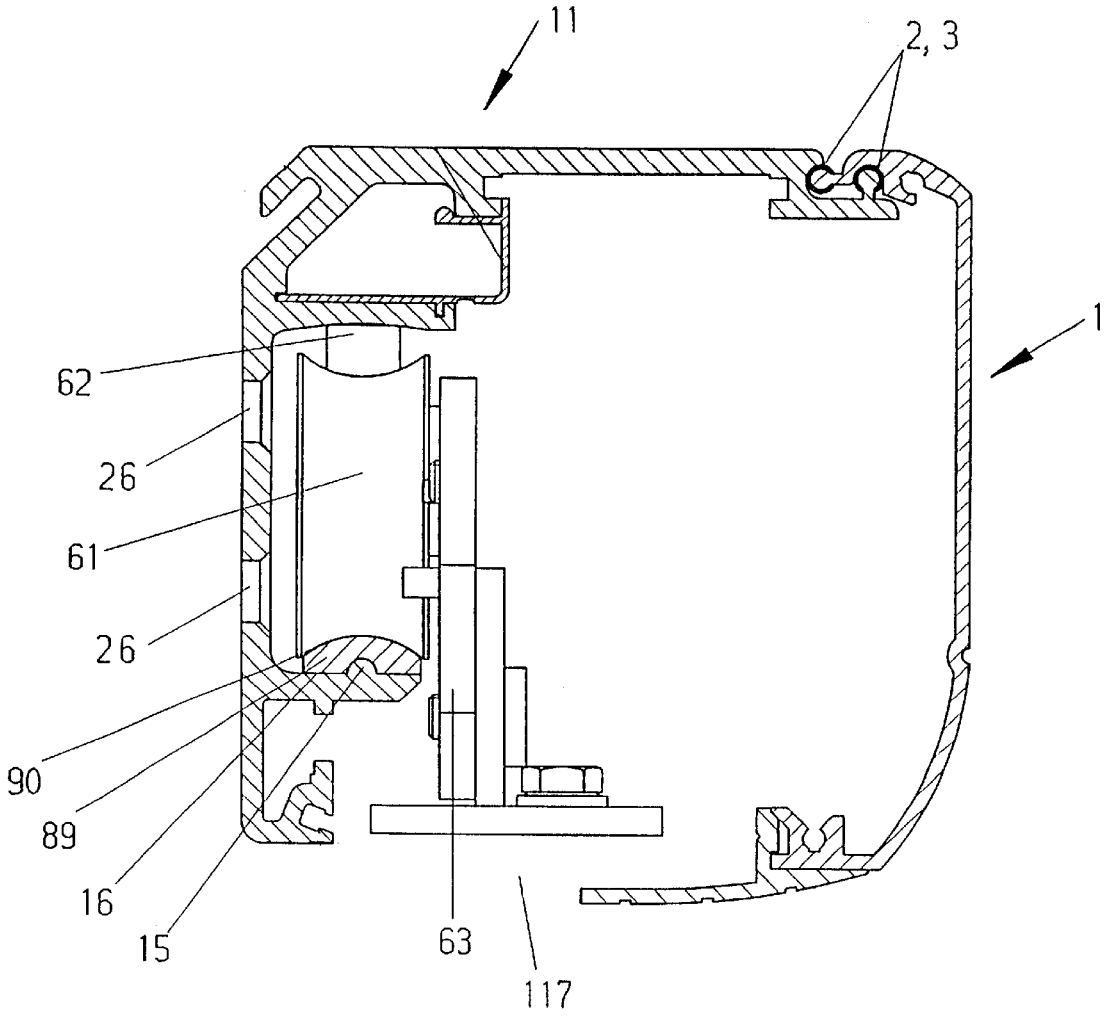
FIG. 9 shows a housing for an automatic door mechanism having a removable housing closure according to at least one embodiment of the present invention.

FIG. 9 shows a housing for an automatic door mechanism having a removable housing closure 1 and a stationary housing part 11 according to at least one embodiment of the present invention. The door mechanism has a housing which at least partially encloses a guide rail system. A trolley 63 is supported on a supporting surface 16 by a roller 61. The roller is guided by a support roller 62 and runs on the running surface 90 of the running section 89 located on top of the supporting surface 16, which surface has a projecting portion 15. Fastening holes 26 are located at the back portion of the housing to mount the housing to a wall or profile. A hanging partition or wall element (not shown) can be hung from the trolley 63 through the opening 117 in the housing. Convex moldings 2, 3 are also shown according to at least one embodiment of the present invention.

Figure 10:
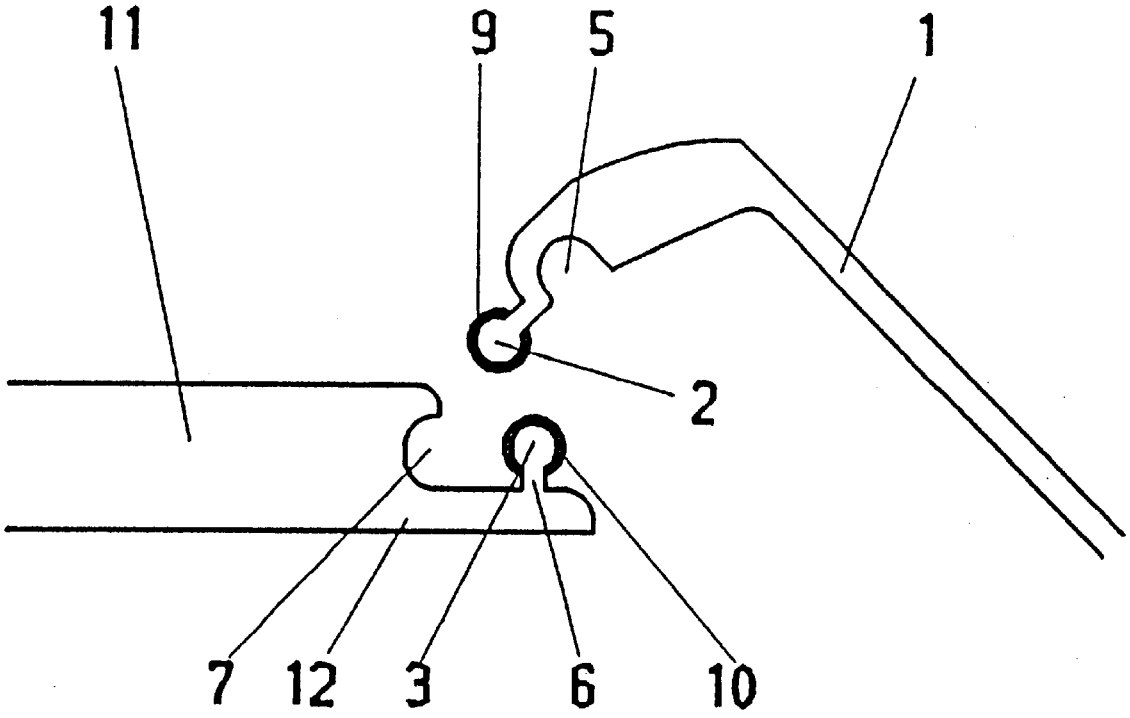
FIG. 10 shows an enlarged view of the tapered section of each of the webs of the housing closure and the stationary part according to at least one embodiment of the present invention.

FIG. 10 shows an enlarged view of the housing closure 1 and the stationary housing part 11 according to at least one embodiment of the present invention. The webs 4, 6 have tapered sections.

One feature of the invention resides broadly in the hinged connection between a removable housing closure and a stationary housing part, characterized by the fact that a terminal configuration of the housing closure 1 has a convex molding 2, with a web 4 that is contiguous with the molding 2 and has a tapering cross section, and contiguous with the web 4 there is a indentation 5, in which a convex molding 3 that is on the stationary housing part 11 and is offset by an angle of 90 degrees with respect to the molding 2 is engaged by means of a contiguous web 6 that has a tapering cross section, so that the housing closure 1 can be pivoted with respect to the stationary housing part 1 and re-engaged with it.

Another feature of the invention resides broadly in the hinged connection characterized by the fact that on the stationary housing part 11 there is a indentation 7 in which the molding 2 is engaged.

Yet another feature of the invention resides broadly in the hinged connection characterized by the fact that the moldings 2, 3 are realized in the shape of a partial sphere.

Still another feature of the invention resides broadly in the hinged connection characterized by the fact that the indentation 5 is inside the housing closure 1.

A further feature of the invention resides broadly in the hinged connection characterized by the fact that the moldings 2, 3 are provided with coverings 9, 10.

Another feature of the invention resides broadly in the hinged connection characterized by the fact that the coverings 9, 10 are made of a sound-absorbing material, e.g. plastic.

Yet another feature of the invention resides broadly in the hinged connection characterized by the fact that the stationary housing part 11 and the housing closure 1 are made of aluminum or an aluminum alloy.

U.S. application Ser. No. 09/415,528, having a filing date of Oct. 8, 1999, inventors Andreas Finke and Andreas Althoff, and entitled "HOUSING FOR AUTOMATIC DOOR MECHANISMS" and claiming priority from International Application No. PCT/EP99/00811, filed on Feb. 8, 1999 and Federal Republic of Germany Patent Application No. 198 04 860.2, filed on Feb. 9, 1998, and U.S. application Ser. No. 09/415,334, having a filing date of Oct. 8, 1999, inventor Lothar Ginzel, and, entitled "HOUSINGS FOR AUTOMATIC DOOR MECHANISMS, REVOLVING DOORS, SENSOR STRIPS, SENSOR STRIPS WITH INTEGRATED RAILS, AND SLIDING DOOR DRIVE SYSTEMS HAVING A FASTENING SYSTEM FOR END CAPS OF THE HOUSINGS, WHICH HOUSINGS ARE FORMED BY SECTIONS" and claiming priority from International Application PCT/EP99/00822, filed on Feb. 9, 1999 and Federal Republic of Germany Patent Application No. 198 04 801.7, filed on Feb. 9, 1998, are hereby incorporated by reference as if set forth in their entirety herein.

Some examples of housing or access panels which may be utilized or incorporated in an embodiment of the present invention may be found in the following U.S. Pat. No. 5,327,682, issued on Jul. 12, 1994.

Some examples of guide rails or guide rail arrangements for door, wall or partition systems which may be utilized or incorporated in an embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, or door systems and devices for their operation which may be utilized or incorporated in an embodiment of the present invention may be found in the following U.S. Pat. No. 5,762,123, issued to inventors Kuyama, et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation which may be utilized or incorporated in an embodiment of the present invention may be found in the following U.S. Patents: U.S. Pat. No. 5,930,953, issued to inventor Estfeller on Aug. 3, 1999; U.S. Pat. No. 5,730,027, issued to inventor Hormann on Mar. 24, 1998; U.S. Pat. No. 5,461,829, issued to inventors Lehto, et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillman on May 23, 1995; U.S. Pat. No. 5,544,462, issued to inventor Kordes on Aug. 13, 1996; U.S. Pat. No. 5,406,761, issued to inventors Hobbiebrunken, et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki, et al. on Apr. 10, 1990; U.S. Pat. No. 4,895,246, issued to inventor Rizzi on Jan. 23, 1990; U.S. Pat. No. 4,752,987, issued to inventors Dreyer, et al. on Jun. 28, 1988; U.S. Pat. No. 4,596,094, issued to inventors Teller, et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 198 04 859, filed on Feb. 8, 1998, having inventor Andreas Finke, and DE-OS 198 04 859 and DE-PS 198 04 859 and International Application No. PCT/EP99/00808, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

At Least Partial Nomenclature

1 Housing closure
2 Convex molding

3 Convex molding
4 Web
5 Indentation
6 Web
7 Indentation
9 Cover
10 Cover
11 Stationary housing part
12 Leg
13 Direction of movement

What is claimed is:

1. An openable and closable automatic door system for opening and closing an entrance or exit to an area, said automatic door system comprising:

at least one door element;

at least one trolley being configured and disposed to support said at least one door element;

a housing structure being configured to at least partially enclose said at least one trolley;

said housing structure comprising a stationary portion and a removable portion;

said removable portion being configured to engage and disengage with said stationary portion;

said removable portion comprising:

a convex structure being disposed on an end of said removable portion; and an indentation being disposed adjacent said convex structure;

said stationary portion comprising:

a body;

an extending section which extends from said body;

a convex structure;

a web;

said web being disposed to connect said convex structure of said stationary portion to said extending section; and said web being disposed substantially transversely to said extending section;

said convex structure of said stationary portion being configured and disposed to engage with said indentation;

said removable portion being configured to be pivotable with respect to said stationary portion to permit said convex structure of said stationary portion to engage with said indentation;

said stationary portion comprises an indentation;

said convex structure of said removable portion is configured and disposed to engage with said indentation of said stationary portion; and each of said convex structures is substantially sphere-shape.

2. The automatic door system as claimed in claim 1, wherein:

said removable portion has an interior surface and an exterior surface;

said interior surface is disposed to substantially face said stationary portion; and said indentation of said removable portion is disposed on said interior surface.

3. The automatic door system as claimed in claim 2, wherein each of said convex structures comprises a covering.

4. The automatic door system as claimed in claim 3, wherein each of said coverings comprises sound-absorbing plastic material.

5. The automatic door system as claimed in claim 4, wherein:

said stationary portion and said removable portion comprise one of: aluminum and an aluminum alloy;

said web has a tapered cross-section; and said web is disposed at about a 90 degree angle with respect to said extending section.

6. An openable and closable door system for opening and closing an entrance or exit to an area, said door system comprising:

at least one door element;

at least one trolley being configured and disposed to support said at least one door element;

a housing structure being configured to at least partially enclose said at least one trolley;

said housing structure comprising a stationary portion and a removable portion;

said removable portion being configured to engage and disengage with said stationary portion;

said removable portion comprising:

a convex structure being disposed on an end of said removable portion; and an indentation being disposed adjacent said convex structure;

said stationary portion comprising:

a body;

an extending section which extends from said body;

a convex structure;

a web;

said web being disposed to connect said convex structure of said stationary portion to said extending section; and said web being disposed substantially transversely to said extending section;

said convex structure of said stationary portion being configured and disposed to engage with said indentation;

said removable portion being configured to be pivotable with respect to said stationary portion to permit said convex structure of said stationary portion to engage with said indentation;

said stationary portion comprises an indentation;

said convex structure of said removable portion is configured and disposed to engage with said indentation of said stationary portion; and each of said convex structures is substantially sphere-shaped.

7. The door system as claimed in claim 6, wherein:

said removable portion has an interior surface and an exterior surface;

said interior surface is disposed to substantially face said stationary portion; and said indentation of said removable portion is disposed on said interior surface.

8. The door system as claimed in claim 7, wherein:

each of said convex structures comprises a covering;

each of said coverings comprises sound-absorbing plastic material;

said stationary portion and said removable portion comprise one of: aluminum and an aluminum alloy;

said web has a tapered cross-section; and said web of said stationary portion is disposed at about a 90 degree angle with respect to said extending section.

* * * * *